US007651443B1

(12) United States Patent
Fenster et al.

(10) Patent No.: US 7,651,443 B1
(45) Date of Patent: Jan. 26, 2010

(54) EXERCISE APPARATUS

(75) Inventors: Mrako A. Fenster, Madison, WI (US); Hai Jun Zhu, Yancheng (CN)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 0 days.

(21) Appl. No.: 12/291,419

(22) Filed: Nov. 12, 2008

(51) Int. Cl.
*A63B 9/00* (2006.01)
*A63B 21/062* (2006.01)

(52) U.S. Cl. ..... 482/37; 482/103; 482/138

(58) Field of Classification Search ..... 482/35–37, 482/44, 47–50, 92–96, 99, 101–103, 138; D21/673, 675, 686, 826, 827
See application file for complete search history.

(56) References Cited

U.S. PATENT DOCUMENTS 3,614,097 A * 10/1971 Blickman ..... 482/72
4,856,773 A * 8/1989 Deola ..... 482/102
5,725,459 A * 3/1998 Rexach ..... 482/92
6,447,430 B1 * 9/2002 Webb et al. ..... 482/98
6,685,601 B1 * 2/2004 Knapp ..... 482/104
7,070,546 B1 * 7/2006 Grasso ..... 482/103
2002/0091043 A1 * 7/2002 Rexach ..... 482/98
2009/0017997 A1 * 1/2009 Piggins ..... 482/94

OTHER PUBLICATIONS

LifeFitness Cable Motion Dual Adjustable Pulley exercise machine, CMDAP, LifeFitness online catalog pp. 60-67, downloaded Mar. 2005 from lifefitness.com.*
http://us.commercial.lifefitness.com/content.cfm/dualadjustablepulley.

* cited by examiner

*Primary Examiner*—Loan H Thanh
*Assistant Examiner*—Victor K Hwang

(57) ABSTRACT

The present invention relates to an exercise apparatus which is a multiple functions exercise apparatus. One function of the exercise apparatus allows the user taking chin-up exercise substantially solely by his fingers. The exercise apparatus comprises a frame, two guiding mechanisms respectively connected to the left and right sides of the frame, a load unit positioned on the frame, a cable-and-pulley device connected to the frame and linked the load unit and the guiding mechanisms, and the cable-and-pulley device further having two pulling portions engaged with respective guiding mechanisms, at least an exercise accessory operable connected to at least one pulling portion, at least two climbing-holds mounted on the frame for the user gripping thereon and taking chin-up exercise.

13 Claims, 5 Drawing Sheets

EXERCISE APPARATUS

CROSS-REFERENCE TO RELATED APPLICATION

This application claims priority of Taiwanese Invention Patent Application No. 097128719, filed on Jul. 25, 2008.

BACKGROUND

1. Field of the Invention

This invention relates to an exercise apparatus, more particularly to a multi-function exercise apparatus which permits a user to train in various exercise types.

2. Description of the Related Art

Recently, rock-climbing exercise has became well-known to the public. However, it is difficult for everyone to practice the rock-climbing exercise. One of the reasons is that the natural rock formations is usually in a remote area. And it will take a lot of time to reach the area. Although indoor rock-climbing may solve the traffic problems and provide people a convenience and safe climbing environment. It still exists another problem. Rock-climbing demands the user to have powerful muscles in the arms and fingers to climb variety routes.

When a user wants to tone up muscles of his body, indoor weight-training exercise is relatively easy to contact. However, popular weight-training exercise machines which focus on single function are generally used to train major muscle groups of the body, such as chest press, abdominal training or arm curl. This kind of weight-training exercise machines lack the function of training minor muscle groups, such as fingers. Therefore, it is difficult to provide a user overall muscle training in one exercise apparatus.

Other exercise machines, such as multiple functions weight-training exercise machine, can be generally separated into two types. One is the multiple-stations type. This kind of exercise machines integrates many traditional single function weight-training exercise machines to provide the user numerous exercise types in less space. But, these machines also have the same shortcoming the same with the single function weight-training exercises.

Another type is a multiple functional weight-training exercise machines which have at least one or more pulling portions to allow the user to link variety of accessories. By using different accessories in different operational methods, the user may do more exercise types than with the multiple-stations types. Some of these machines have the function to allow the user to do chin-up exercise by mounting rods or bars on the frame, for example, the "Dual Adjustable Pulley" produced by Life fitness. But these machines still lack the function of permitting the user to further training minor muscles.

Clearly for the forgoing reasons, there is still a need for an exercise apparatus which can make the user to take more comprehensive training.

SUMMARY

The present invention relates to an exercise apparatus, which has multiple functions for a user to take variety of exercises to fully train himself. A function of the exercise apparatus allows the user to take chin-up exercise by his fingers. Therefore, the user can utilize this function to further increase the power of his fingers, arms, and back.

An exercise apparatus in accordance with the present invention comprises a frame adapted to rest on a plane. The frame has a left upright and a right upright. And an exercise space is defined between the left upright and right upright. The exercise apparatus also comprises two guiding mechanisms respectively connected to the left and right sides of the frame, a load unit positioned on the frame, a cable-and-pulley device which has a plurality of pulleys connected to the frame and at least one cable wound around the plurality of pulleys and linked the load unit to the guiding mechanisms, and the cable has two pulling portions. The exercise apparatus further comprises at least one exercise accessory operably connected to the at least one pulling portion, and at least two climbing-holds mounted on the frame above the exercise space, each of the climbing-hold has a fingertip-gripping portion for the user gripping thereon and doing chin-up exercise in the exercise space.

These and other features, aspects, and advantages of the present invention will become better understood with reference to the following description and claims.

DETAIL DESCRIPTION

Figure 1:
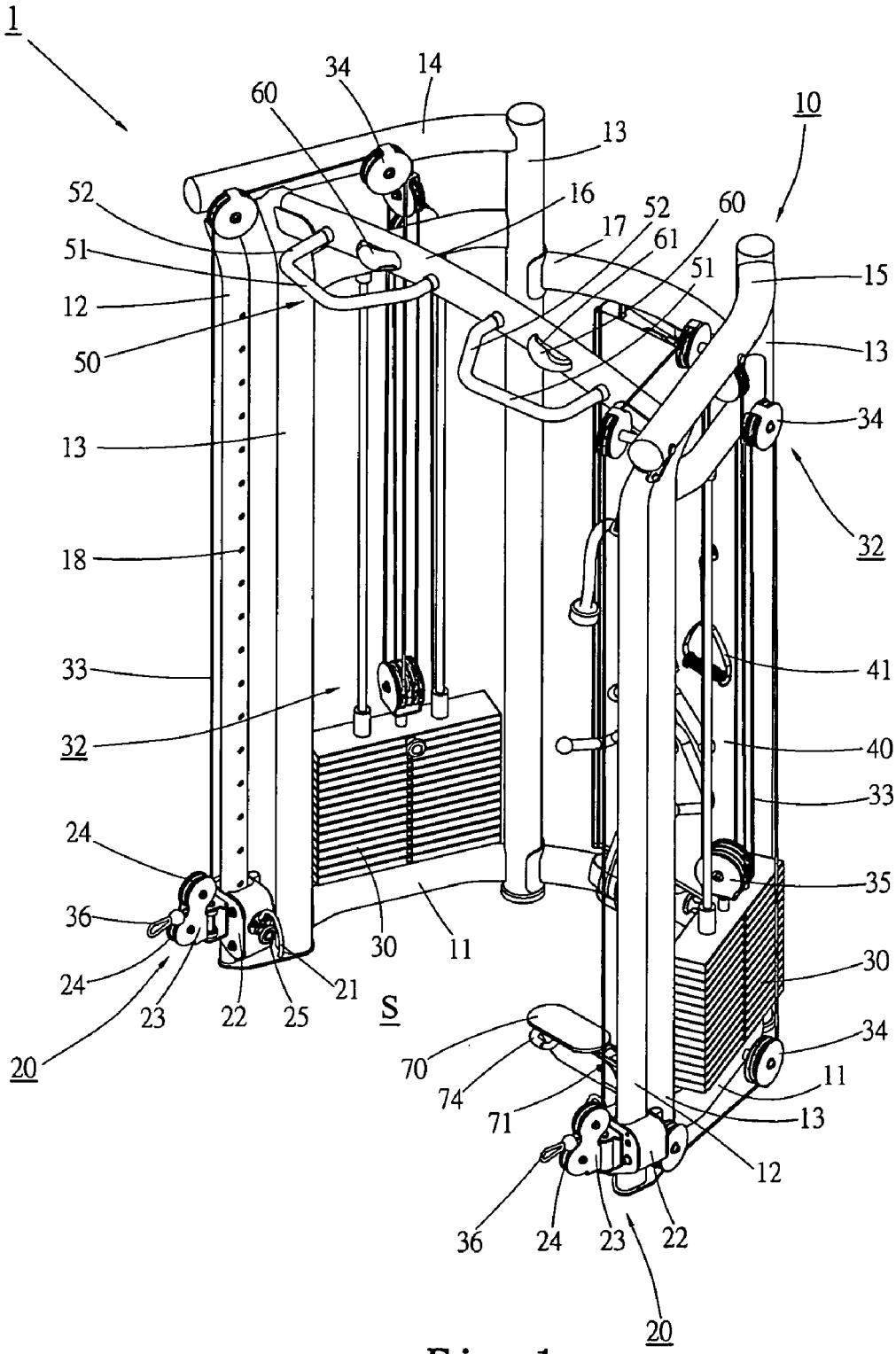
FIG. 1 is a perspective view of an exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1 to FIG. 4, a preferred embodiment of the present invention is an exercise apparatus 1 with which has multiple functions for people exercising illustrated herein. The exercise apparatus 1 comprises a frame 10 configured on a plane to provide other mechanisms to couple thereto, two guiding mechanisms 20 positioned at the left and right side of the facade of the frame 10, two handles 50 located at the upper portion of the frame 10, two climbing-holds 60 mounted on the frame 10 and surrounded respectively by the two handles 50, and a plurality of exercising accessories 41.

Figure 3:
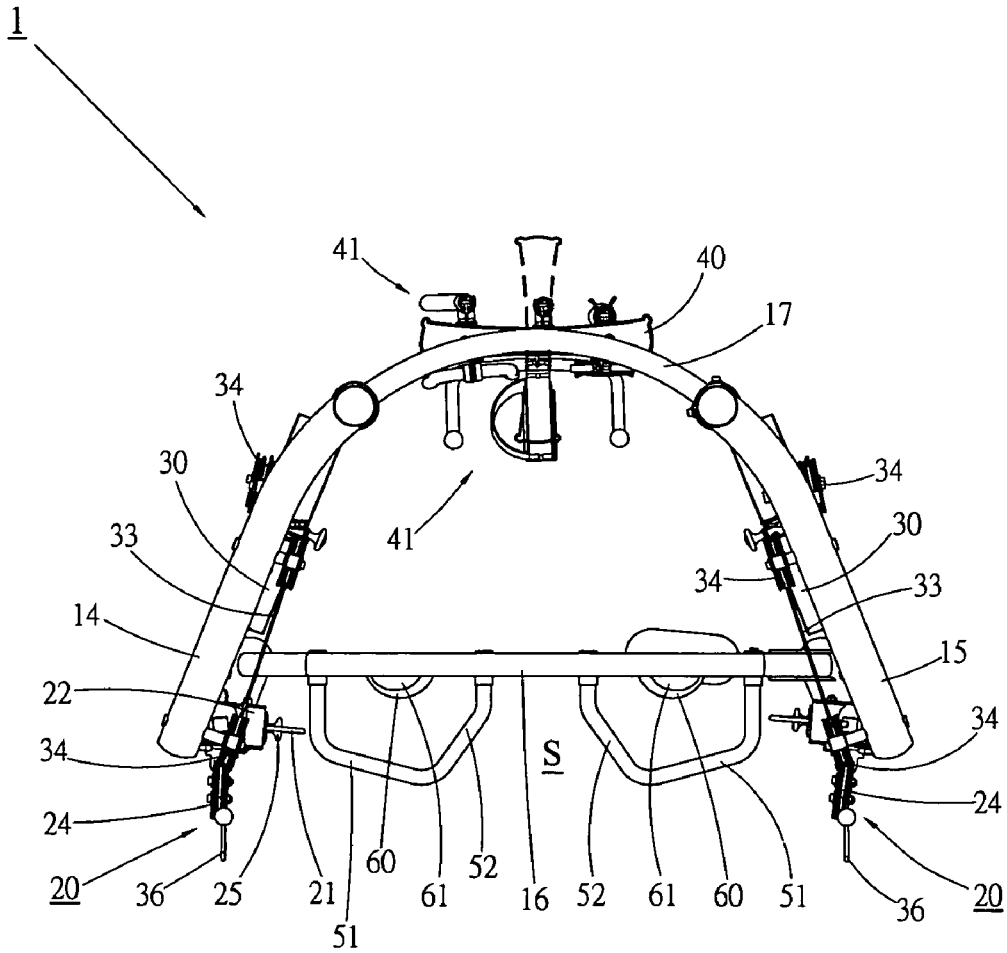
FIG. 3 is a top view of the exercise apparatus of FIG. 1.
Figure 4:
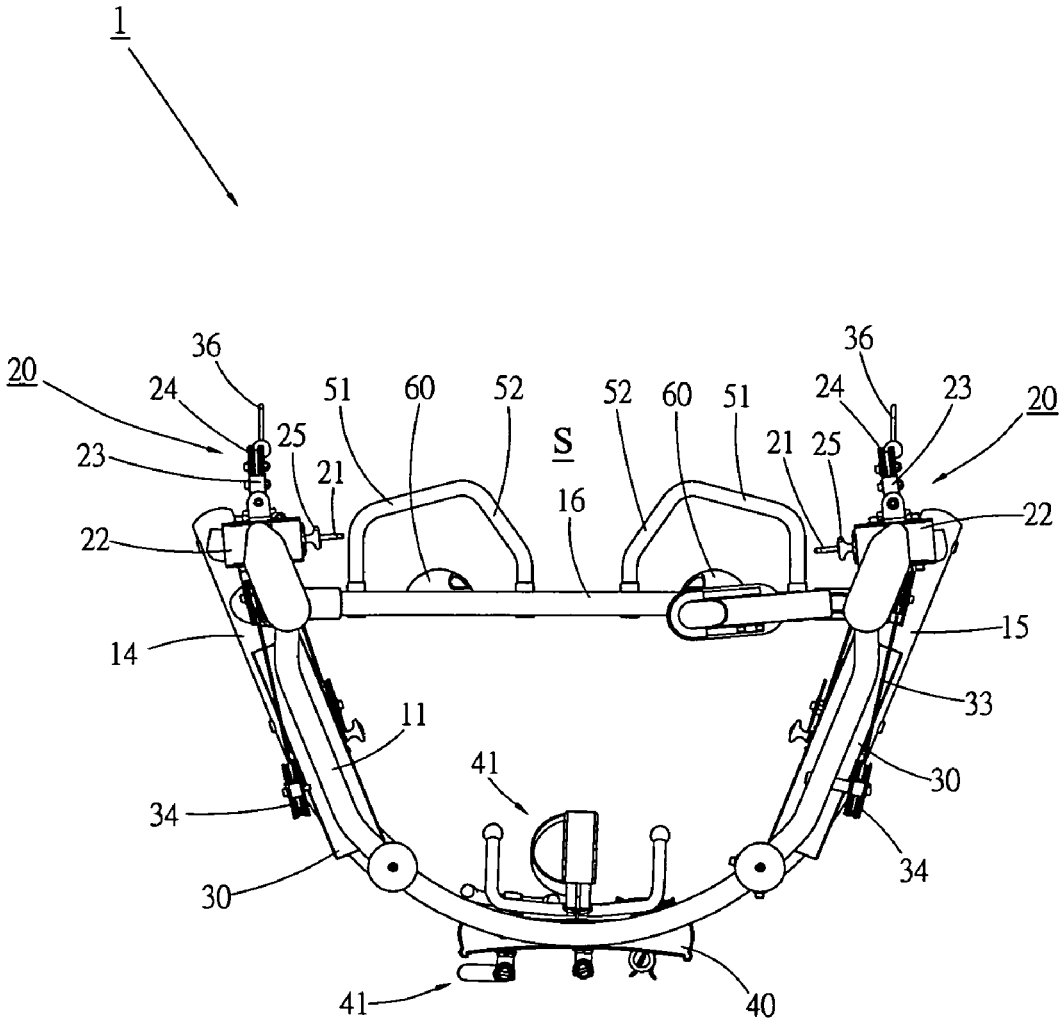
FIG. 4 is a bottom view of the exercise apparatus of FIG. 1.

Please refer to FIG. 1, the frame 10 comprises a base 11, left and right columns 12, left and right uprights 13, and an upper portion. The base 11 is adapted to rest on the plane, such as the ground. The base 11 is approximately in the form of U-shape. Therefore, the base 11 has an open portion. And the left and right columns 12 are respectively mounted at the left and right side of the open portion of the base 11. Four uprights 13 are substantially symmetrically divided into left and right groups and respectively mounted at left and right portion of the base 11. The front left and right uprights 13 are also mounted at the open portion of the base 11. Each of the columns 12 and the uprights 13 are substantially extended perpendicularly to the upper portion of the frame 10 and mounted thereon. Referring to FIG. 3, as the top view illustrated, the upper portion of the frame 10 has a left crossbeam 14, a right crossbeam 15, a front crossbeam 16 and a rear crossbeam 17. The front crossbeam 16 is at the same side with the open portion of the base 11. Referring to FIG. 3 and FIG. 4, the left crossbeam 14, the right crossbeam 15, and the rear crossbeam 17 of the upper portion also substantially form as another U-shape. The U-shape of the base 11 and another U-shape of the upper portion are approximately superimposed. Therefore, the entire frame 10 is presented as a standing U-shaped pillar and the interior thereof is hollow.

Figure 2:
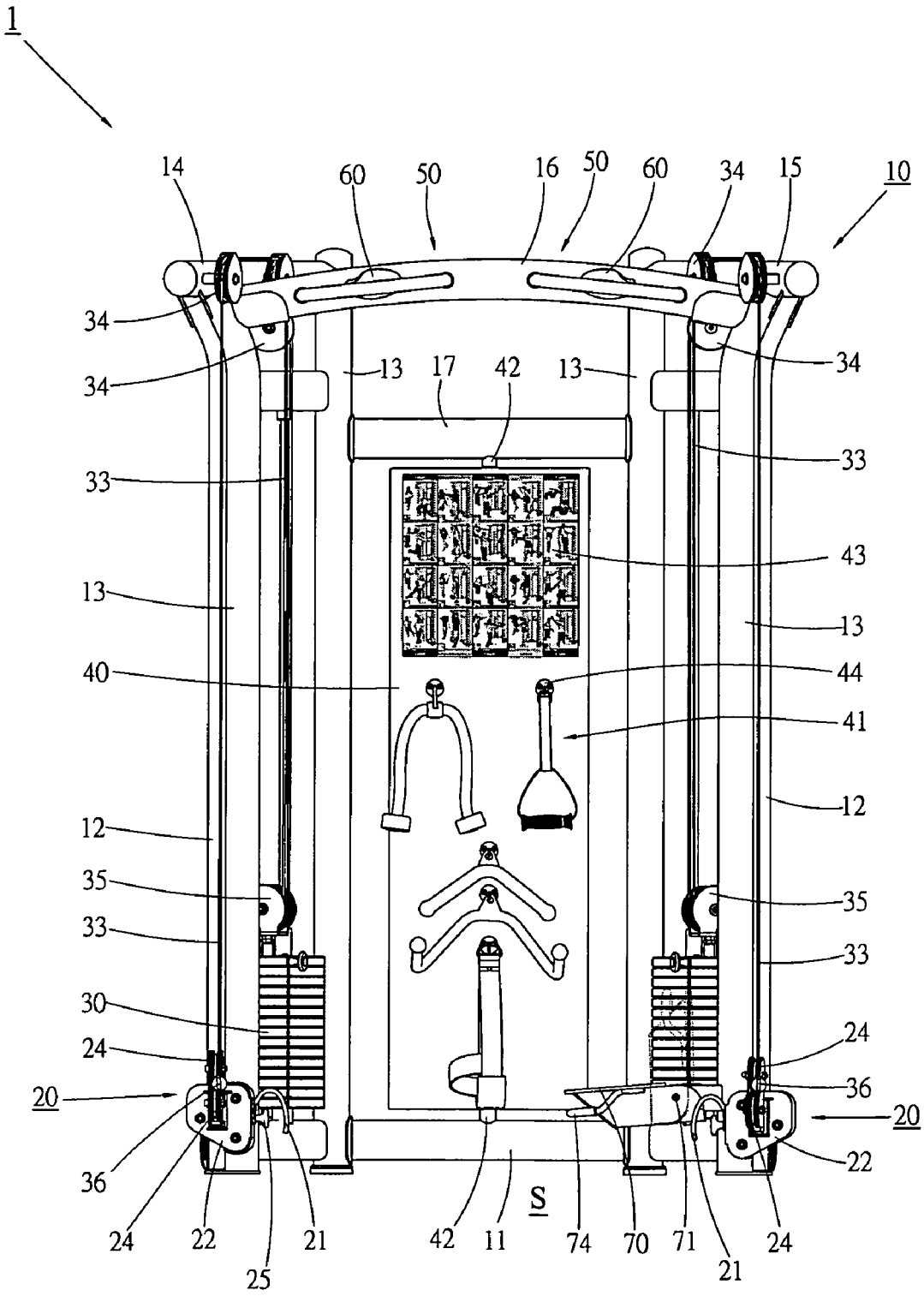
FIG. 2 is a front view of the exercise apparatus of FIG. 1.

Depicted in FIG. 1 and FIG. 2, two guiding mechanisms 20 are respectively connected to the left and right columns 12. Each of the guiding mechanisms 20 comprises an adjustable element 22. The user can adjust the adjustable elements 22 to move lengthwise along the corresponding columns 12. There are two handlebars 21 respectively mounted on the adjustable elements 22. And around each of the handlebars 21, there are two movable bolts 25 respectively connected to the adjustable elements 22. Furthermore, several locating holes 18 are configured on each of the left and right columns 12. When the user wants to change the height of one of the adjustable elements 22, he can grip the handlebar 21 and pull out the movable bolt 25 by his fingers, then adjust the adjustable element 22 to a height. Finally, the user releases the movable bolt 25 and makes the movable bolt 25 insert into corresponding locating hole 18 to fix the adjustable element 22 at the height. Each of the guiding mechanisms 20 further comprises a deflective member 23 pivoted to the corresponding adjustable member 22. In the preferred embodiment of FIG. 1, each of the deflective members 23 is vertically pivoted to the corresponding adjustable member 22. Therefore, each of the deflective members 23 can be rotated to left and right sides freely. Besides, there are two pulleys 24 vertically arranged inside each of the deflective members 23.

Referring to FIG. 1, there are two load units 30 and cable-and-pulley devices 32 respectively positioned at the left and right portion of the frame 10. In the preferred embodiment, each of the load unit 30 is formed by a plurality of weight plates, such as weight stacks, slideably engaged on the frame 10. Each of the cable-and-pulley device 32 comprises a plurality of fixed pulleys 34 connected to the frame 10, a plurality of floating pulleys 35, and at least one cable 33 linked to the respective load unit 30 and wound around the fixed pulleys 34 and floating pulleys 35. In the preferred embodiment, in order to make the user easy to start to exercise, the cable 33 is designed to wind around the fixed pulleys 34 and floating pulleys 35 in the proportion of the user exerting force of one kilogram to pull up the weight of four kilograms of single load unit 30. The end of each of the cable 33 is arranged respectively to pass through a gap between two pulleys 24 which are arranged inside the deflective member 23. And each of the end of the cable 33 forms as a pulling portion 36. Each of the pulling portions 36 of the cable 33 can be pulled out by the user to overcome resistance produced by the corresponding load unit 30. It is contemplated, however, people skilled in the art can also adapted other mechanisms to replace the weight plate to produce resistance, such as elasticity, magnetic force, or friction.

Referring to FIG. 2 and FIG. 3, under the rear crossbeam 17, there is a rotating member 40 pivoted to the frame 10. In the embodiment, the rotating member 40 is a rectangular panel which has two sides. At approximately the middle of the top and bottom width of the rotating member 40, the rotating member 40 is pivoted to the frame 10 vertically by an axle 42. Thus, as shown in dotted line in FIG. 3, the rotating member 40 can be rotated relative to the frame 10. Space around the exercise apparatus 1 can be divided into two parts as placing a virtual vertical plane via the axle 42 of the rotating member 40 and the virtual plane is parallel to the axle 42. Thus, the space around the exercise apparatus 1 is substantially divided as an operational space which allows the user exercising with the exercise apparatus 1 and a rear space behind the exercise apparatus 1. Please refer to FIG. 5 and FIG. 6, there are a plurality of hangers 44 mounted on the both sides of the rotating member 40 to provide the user to hang exercise accessories 41 thereon. Therefore, each of the sides of the rotating member 40 is adapted to become a vertically stowed space which allows the user to stow the exercise accessories 41.

Figure 6:
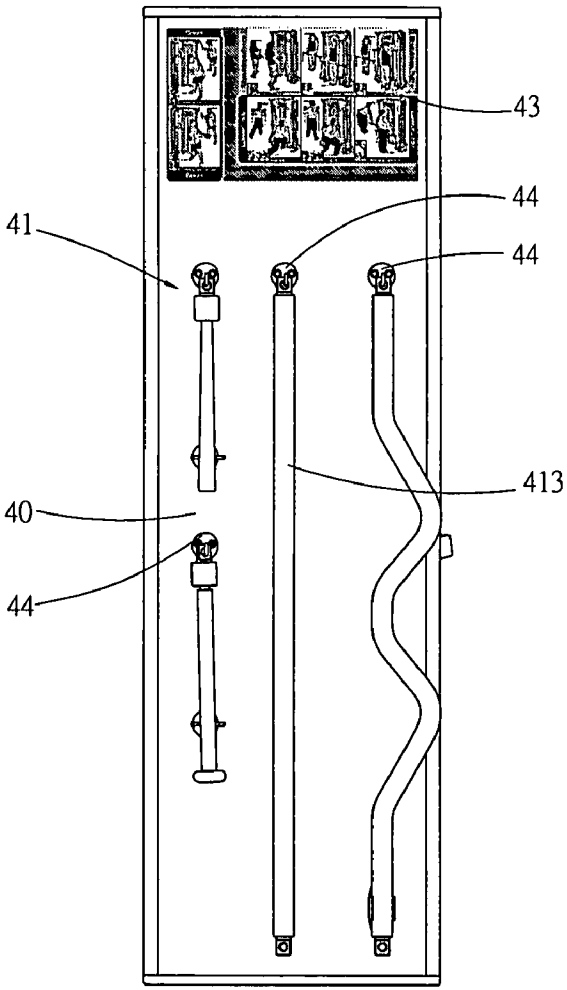
FIG. 6 is another side view of the rotating member of FIG. 5.
Figure 5:
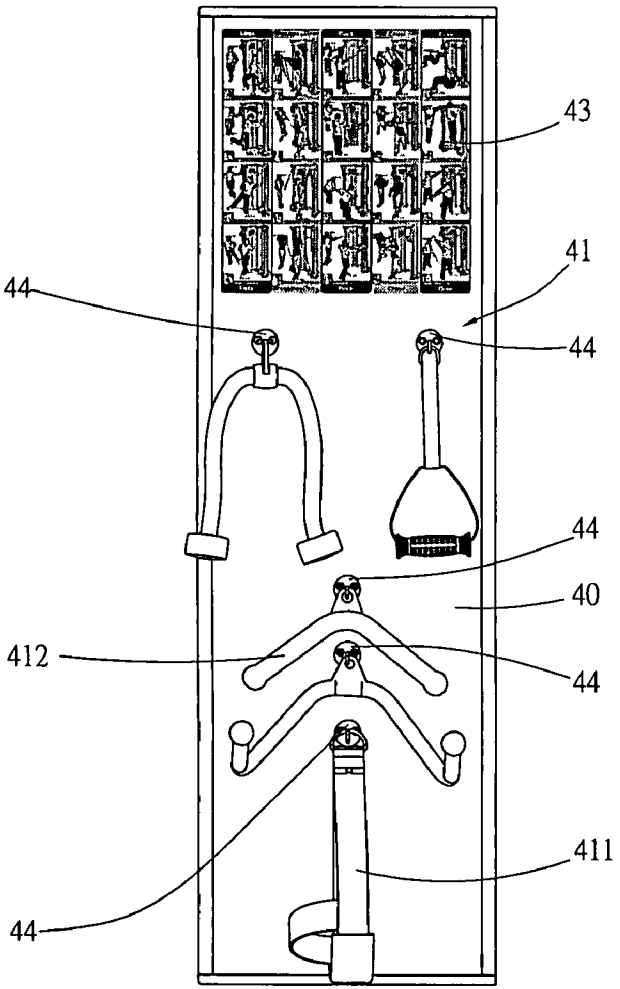
FIG. 5 is a side view of a rotating member of the exercise apparatus.

Referring to FIG. 5 and FIG. 6, there are several exercise modes 43 attached on the upper portions of two sides of the rotating member 40. Each of the exercise modes 43 illustrates an exercising type which teaches the user to choose an appropriate exercise accessory 41 to exercise in correct way. In the embodiment, in order to make the user easy to exercise, the exercise accessories 41 and the exercise modes 43 which are disposed on the same side are matched up. Therefore, the user can choose an exercise accessory 41 and directly read the corresponding exercise mode 43 on the same side of the rotating member 40. Besides, in order to make the user easy to put away the exercise accessories 41, each of the hangers 44 are mounted in a predetermined distance. The predetermined distance is consistent with the size of each of the exercise accessories 41. So that, the user can directly stow an exercise accessory 41 at correct position rather than clutter up.

When the user uses the exercise apparatus 1, he can rotate the rotating member 40 to make one vertically stowed space face the operational space and chooses one exercise accessory 41. Then, he can refer to the exercise mode 43. Finally, he may connect the exercise accessory 41 to one or two of the pulling portions 36 for exercise.

The exercise accessories 41 such as V-bar 412, long-straight bar 413, and leg-linked strap 411. According to the function of the exercise accessory 41 chosen by the user, the exercise accessory 41 is used to connected to one or two pulling portions 36. The user can take variety of exercise types by connecting different exercise accessories 41 to the pulling portions 36. For example, the user can choose the leg-linked strap to connect to one of the pulling portions 36, and then lower the respective guiding mechanism 20 to close to the ground. Then, the user connects the leg-linked strap to one of his lower legs and exerts force to overcome the resistance produced by the respective load unit 30. Or the user adjusts two guiding mechanisms 20 to the height substantially equal to his chest. And linking two strap handles separately to the respective pulling portions 36. Then, the user can pull the strap handles by his arms to train the muscles in the arms and chest. With positioning two guiding mechanisms 20 at different height and connecting appropriate exercise accessory 41 thereto, the user can take variety exercise types.

Because the rotating member 40 has two vertically stowed spaces, the rotating member 40 can stow more exercise accessories 41 for the user choosing. And the rotating member 40 also comprises more spaces to attach the exercise modes 43. However, the user does not need to prepare additional space for the exercise apparatus 1. Besides, the rotating member 40 is located at the central part of the exercise apparatus 1. The user can conveniently operate the rotating member 40 and take exercise accessories 41 as mentioned above. In other embodiments, in order to increase more vertically stowed space, people skilled in the art may adapt a cylinder, a triangle pillar, a hexagon pillar, or a revolving member such as the revolving door to replace the rectangular panel.

Now referring to FIG. 1, as described above, the frame 10 is presented as a U-shaped pillar. The left side and right side of the U-shaped pillar are symmetry. As the user standing in front of the facade of the frame 10, in other words, standing in front of the open portion of the U-shaped pillar, the user can observe a space which is defined by the left and right uprights 13 and the front crossbeam 16. The space is an exercise space S. That is to say a space which substantially extends vertically from the open portion of the base 11 to the front crossbeam 16 being defined as the exercise space S. Please refer to FIG. 2 to FIG. 4, there are left and right handles 50 mounted on the facade of the front crossbeam 16 to provide the user to take general chin-up exercises in the exercise space S. Depicted in FIG. 3, each of the handles 50 forms as a polygon and substantially comprises a first grasping portion 51 and a second grasping portion 52. Axes of the first grasping portions 51 and the second grasping portions 52 have different angle. Therefore, the handles 50 provide the user different grasping type to do the chin-up exercise. Besides, each of the left and right handles is configured to incline toward the front crossbeam 16 from near the central part to the outer part. Please refer to FIG. 4, when the user stands in the exercise space S and faces the exercise apparatus 1, and extends his arms upwardly to grasp the left and right handles 50, axes of his left and right fists are substantially identical to the axes of the first grasping portions 51 of the left and right handles 50. Therefore, the left and right handles 50 allow the user to do chin-up exercise more comfortably.

Referring to FIG. 1 and FIG. 3, there are left and right climbing-holds 60 mounted on the facade of the front crossbeam 16 which are surrounded by the left and right handles 50. The left climbing-hold 60 and the right climbing-hold 60 are substantially at equal height. Each of the left and right climbing-holds 60 has a fingertip-gripping portion 61 for the user to grip thereon to take high degree of intensity chin-up exercise by his fingers. The fingertip-gripping portions 61 can be as several holes, concaves, apertures, or curved down surfaces which are configured on the left and right climbing-holds 60. In order to make the user easy to grip the left and right climbing-holds 60, each of the climbing-holds 60 is surrounded by the respective handles 50. So that, when the user wants to exercise with the left and right climbing-holds 60, he can adapt a method of grasping the left and right handles 50 first, and then gripping the left and right climbing-holds 60. By using the left and right handles 50, the user can take general intensity of chin-up exercise to train himself. As having more power, the user can use the left and right climbing-holds 60 to take higher degree of chin-up exercise and completely trains the muscles in his fingers, arms, and the back.

In the embodiment, the user can take another method to use the left and right climbing-holds 60 besides the method of grasping the left and right handles 50 described above. Please refer to FIG. 2, there is a pedal 70 located in the exercise space S. The pedal 70 is positioned in the right side and lower portion of the exercise space S which is pivoted to the frame 10 via a pivot axis 71 at a height from the ground. The pedal 70 further has a gripping-ring 74 for the user conveniently operating the pedal 70. Therefore, the pedal 70 can be operated to position in a first position for the user to step up upon the pedal to lift himself for easily gripping the left and right climbing-holds 60. As the user taking other exercises, the pedal 70 can be folded out in a second position as showing in dotted line to storage and to move the pedal 70 out of the way of the user.

The preferred embodiment does not require that all the advantageous features and all the advantages described need to be incorporated into every embodiment thereof. Although the present invention has been described in considerable detail with reference to certain preferred embodiments thereof, other embodiments are possible. Therefore, the spirit and scope of the appended claims should not be limited to the description of the preferred embodiment contained herein.

What is claimed is:

1. An exercise apparatus, comprising:

(a) a frame configured on a plane comprising a left upright and a right upright, wherein an exercise space is defined between the left upright and the right upright;

(b) at least one guiding mechanism connected to the frame, wherein the guiding mechanism can be adjusted and located in a position;

(c) at least one load unit positioned on the frame;

(d) a cable-and-pulley device comprising a plurality of pulleys connected to the frame and at least one cable wound around the plurality of pulleys and linked the load unit to the guiding mechanism, the cable comprising a pulling portion;

(e) at least an exercise accessory operably connected to the pulling portion for allowing a user to perform at least one exercise; and (f) two climbing-holds approximately horizontally mounted on the frame above the exercise space, each of the climbing-holds comprising a fingertip-gripping portion which has plurality of concave surfaces for fingertips of the user engaging thereon to support at least a portion of the weight of the user from the fingertips and doing chin-up substantially in the exercise space.

2. The exercise apparatus of claim 1, further comprising a pedal integrally connected to the frame and located in a lower portion of the exercise space, wherein the pedal is at a height from the plane for providing the user to step thereon to grip the fingertip-gripping portions of the climbing-holds.

3. The exercise apparatus of claim 2, wherein the pedal is pivotally connected to the frame, the pedal positioned at a first position allowing the user to step up the pedal as the user using the climbing-holds to do chin-up and at a second position as the user using the exercise accessory to do other exercises.

4. The exercise apparatus of claim 1, the frame further comprising a base approximately in the form of U-shape, wherein the base has an open portion and the left and right uprights are positioned at the open portion of the base.

5. The exercise apparatus of claim 1, the frame further comprising a crossbeam mounted respectively on upper portions of the left and right uprights and the climbing-holds mounted on the crossbeam.

6. The exercise apparatus of claim 1, further comprising a handle connected to the frame wherein the handle is positioned at approximately equal height with the climbing-holds.

7. The exercise apparatus of claim 1, further comprising two handles, each of the handles configured around the respective climbing-holds.

8. An exercise apparatus, comprising:

(a) a frame configured on a plane comprising a left upright, a right upright, and a crossbeam mounted on upper portions of the left and right uprights, wherein an exercise space is defined between the left upright and the right uptight, the exercise space being under the crossbeam;

(b) at least a load unit positioned on the frame;

(c) a cable-and-pulley device comprising at least a pulley connected to the frame and at least one cable linked to the load unit and wound around the pulley, the cable comprising a pulling portion;

(d) at least one exercise accessory operably connected to the pulling portion of the cable for allowing a user to perform at least one exercise; and (e) two fingertip-gripping portions approximately horizontally configured on the crossbeam, each of the fingertip-gripping portions shaped to engage fingertips of the user for supporting at least a portion of the user's weight from the fingertips and allowing the user to grip thereon doing chin-up exercises substantially in the exercise space.

9. The exercise apparatus of claim 8, further comprising two climbing-holds, wherein the fingertip-gripping portions are located respectively on the climbing-holds.

10. The exercise apparatus of claim 8, further comprising a handle connected to the frame, wherein the handle is positioned at approximately equal height with the fingertip-gripping portions.

11. The exercise apparatus of claim 8, further comprising two handles, each of the handles configured around the respective fingertip-gripping portions.

12. The exercise apparatus of claim 8, further comprising a pedal integrally connected to the frame for the user stepping thereon to grip the fingertip-gripping portions.

13. The exercise apparatus of claim 12, wherein the pedal is pivotally connected to the frame, the pedal having a first position for use as a step and a second position for storage.

* * * * *